United States Patent [19]

Lacko

[11] Patent Number: 4,936,033

[45] Date of Patent: Jun. 26, 1990

[54] UNITARY POSTER FRAME ASSEMBLY

[75] Inventor: Mark Lacko, Cold Spring, N.Y.

[73] Assignee: Index Industrial Design & Development, Inc., New York, N.Y.

[21] Appl. No.: 4,431

[22] Filed: Jan. 20, 1987

[51] Int. Cl.[5] ..... A47G 1/06; G09F 1/12

[52] U.S. Cl. ..... 40/154; 40/152; 40/152.1; 40/611

[58] Field of Search ..... 40/152, 152.1, 156, 40/154, 16, 10 R, 155, 156, 158 R, 152, 611

[56] References Cited

U.S. PATENT DOCUMENTS

| | | | |
|---|---|---|---|
| 1,620,046 | 3/1927 | Van Diest | 40/158 R |
| 1,837,521 | 12/1931 | Bohan | 40/152 X |
| 2,247,150 | 6/1941 | Chilcote | 40/158 R |
| 2,296,596 | 9/1942 | Brown | 40/154 |
| 2,419,187 | 4/1947 | Jolly | 40/152 |
| 2,528,366 | 10/1950 | Houston | 40/152 |
| 3,181,869 | 5/1965 | Genin et al. | 40/156 |
| 3,371,439 | 3/1968 | Smith et al. | 40/156 |
| 3,470,642 | 10/1969 | Mundt et al. | 40/152 |
| 3,478,456 | 11/1969 | Mundt et al. | 40/152 |
| 4,041,630 | 8/1977 | Holbrook | 40/152.1 |
| 4,258,488 | 3/1981 | Schienbein | 40/152 |
| 4,282,667 | 8/1981 | Glade | 40/16 |
| 4,518,080 | 5/1985 | Ohlson | 40/10 R |

*Primary Examiner*—Kenneth J. Dorner
*Assistant Examiner*—J. R. Hakomaki
*Attorney, Agent, or Firm*—Michael Ebert

[57] ABSTRACT

A unitary poster assembly molded of flexible synthetic plastic material, the assembly including a rectangular backing plate whose dimensions are slightly smaller than those of the poster. The plate is bordered by an integrated frame formed of top, bottom and left and right side branches, the top branch being spaced from the upper edge of the plate to form an inlet gap. The inner walls of the branches, save for the top branch, are slotted to define a U-shaped socket for receiving the corresponding margins of a poster supported on the backing plate. To install a poster, the top branch is momentarily bent back to admit the lower end of the poster into the inlet gap and to permit insertion of the side margins thereof into the slots of the side branches, the poster then being pushed down until its bottom margin lies in the slot of the bottom branch, at which point the poster is properly mounted. To thereafter remove the poster from the frame assembly, the top branch is again flexed, and the poster is pulled out of the socket.

3 Claims, 3 Drawing Sheets

UNITARY POSTER FRAME ASSEMBLY

BACKGROUND OF INVENTION

1. Field of Invention:

This invention relates generally to frames for mounting posters and the like, and more particularly to a unitary frame assembly formed of synthetic plastic material for accommodating a poster.

2. Status of Prior Art:

By definition, a poster is a bill or placard for posting in a public place. Thus, one finds posters displayed in banks, movie theaters, post offices, railroad stations, airports and in other public places. A poster which takes the form of a printed announcement or advertisement printed on heavy paper or cardboard and intended to be seen for a limited period is usually just tacked or pasted onto a wall, a column or a fence. When the poster has served its purpose, it is torn down and discarded.

But many posters are now intended for permanent display. Thus, posters based on original drawings of Toulouse Lautrec to advertise the Moulin Rouge dance hall in Paris are regarded as masterpieces and these are now expensively framed for display in art galleries or in well-appointed living rooms. Many modern posters are in the form of enlarged photographs of movie or rock stars, or other celebrities, and these are cherished by their fans and framed for display.

Also prevalent are so-called travel posters which depict foreign cities or exotic nature scenes and are intended to induce vacationers to travel to those sites. Such posters are sometimes highly attractive and aesthetically pleasing, and are therefore framed for permanent display.

Posters which are decorative or first-rate reproductions of works of art have in recent years attained a high level of popularity. These can now be purchased throughout the United States and elsewhere in poster stores which stock and offer for sale posters covering a broad range of subjects and themes. Also, museums, when presenting a special exhibit of a particular artist, often publish and offer for sale in museum shops posters which advertise the exhibit and carry a reproduction of one of the artist's works. Because such posters are usually multi-color, high-quality lithographs on glazed cardboard, they are not inexpensive. A typical purchaser is therefore not inclined to simply tack the poster on a wall. When purchasing a poster in a poster store or museum, he usually arranges to have it mounted in a frame suitable for hanging. An unframed poster tacked on a wall appears to be improvised and tends to curl; hence is unacceptable as decor.

In framing a poster, the traditional procedure is to cut frame pieces of wood, extruded metal or other suitable material to form a rectangular frame whose size is appropriate to the poster dimensions, the pieces then being joined together. A rigid backing board is generally placed behind the poster and secured to the frame by nails or tape. Then a hanging wire bridging the opposite sides of the frame is attached to these sides.

In many cases, the professional cost of fabricating a frame for a poster may well exceed the price of the poster itself. And because the poster is sealed into the frame, should one wish to replace the poster with another poster, this cannot easily be done, for one then has to first remove the backing board and the nails or tape which holds the board in place. And after putting in a new poster, one must again nail in the backing board or use tape, clips or other means to hold the backing board to the frame.

To reduce the costs of fabricating a poster frame, the Glade patent No. 4,282,667 discloses a frame formed by a molded plastic backing plate to support the poster, and four molded border pieces with slots therein to receive the margins of the poster, the frame pieces then being clipped onto the backing plate. But this multi-piece frame, though easier to put together and less expensive than a conventional frame, is not a unitary structure. Moreover, to replace the poster in the frame with another poster, one has to disassemble the frame.

The Bell patent No. 2,993,290 forms a frame for a sheet of material such as a poster or picture by means of four channel shaped frame pieces. This, too, is not a unitary frame, and must be disassembled when replacing the poster.

To provide a unitary frame structure for a picture or frame which does not have to be assembled or disassembled, the Lehere patent No. 1,904,318 discloses a frame formed of rubber which can be stretched to accept the picture to be mounted. But a frame of this type lacks rigidity and the other qualities desirable in a good quality frame.

SUMMARY OF INVENTION

In view of the foregoing, the main object of this invention is to provide a unitary frame assembly for mounting a poster or any other stiff, rectangular sheet. This assembly makes it possible to mount the poster simply by inserting it into the assembly, the poster being removable therefrom simply by pulling it out.

A significant advantage of the invention is that the unitary frame assembly may be molded in standard sizes for accommodating the present commercial range of standard poster sizes. Thus, a poster store can carry an inventory of frame assemblies, and a purchaser of a given poster can at the same time acquire a frame assembly whose size is appropriate thereto.

More particularly, an object of this invention is to provide a low cost molded unitary frame assembly of the above type formed of thermoplastic plastic material which lends itself to embossing so that the frame may be given a desired decorative appearance.

Briefly stated, these objects are attained in a unitary poster assembly molded of flexible synthetic plastic material, the assembly including a rectangular backing plate whose dimensions are slightly smaller than those of the poster. The plate is bordered by an integrated frame formed of top, bottom and left and right side branches, the top branch being spaced from the upper edge of the plate to form an inlet gap. The inner walls of the branches, save for the top branch, are slotted to define a U-shaped socket for receiving the corresponding margins of a poster supported on the backing plate. To install a poster, the top branch is momentarily bent back to admit the lower end of the poster into the inlet gap and to permit insertion of the side margins thereof into the slots of the side branches, the poster then being pushed down until its bottom margin lies in the slot of the bottom branch, at which point the poster is properly mounted. To thereafter remove the poster from the frame assembly, the top branch is again flexed, and the poster is pulled out of the socket.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
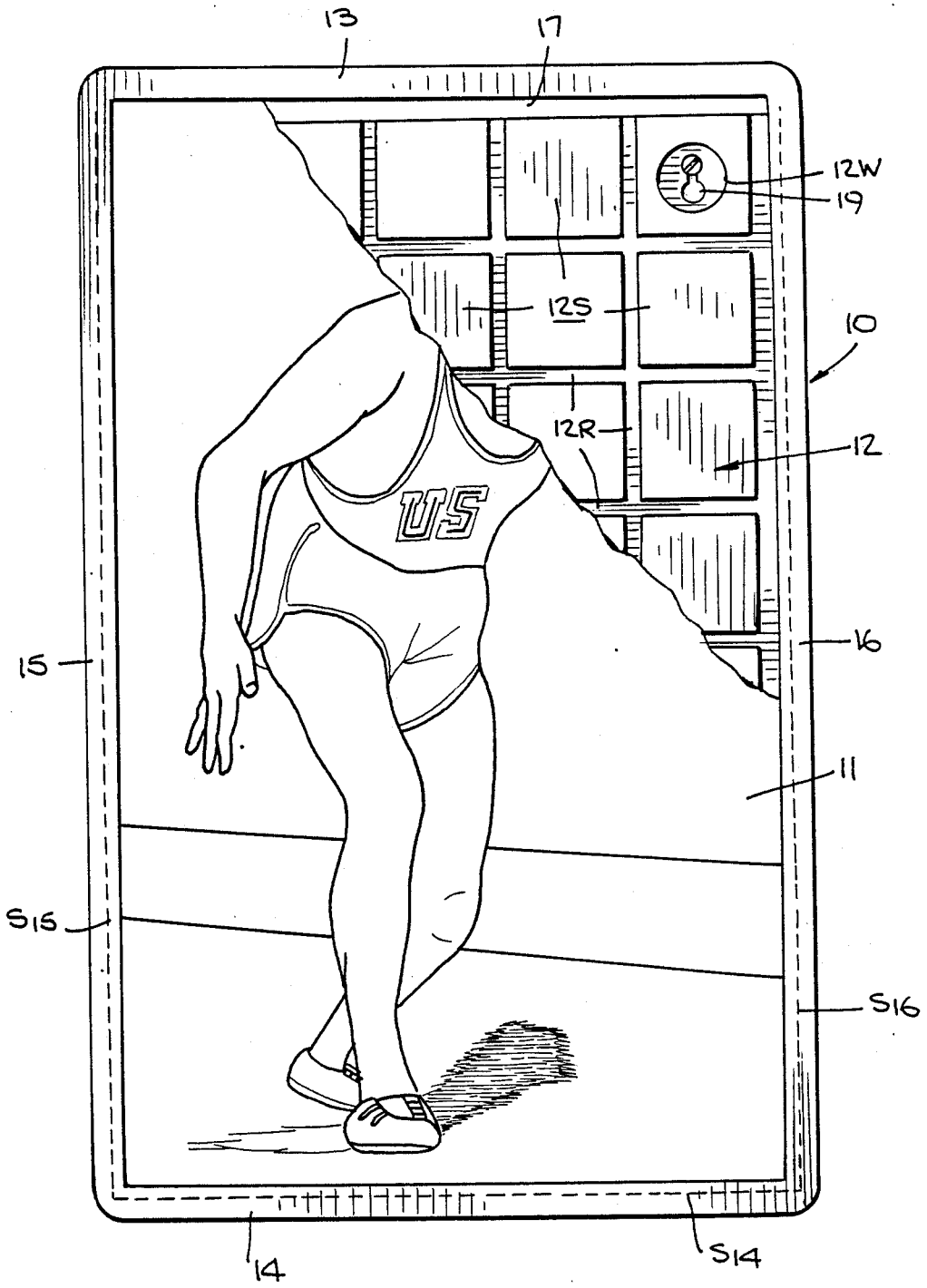
Fig. 1 is a front view of a unitary frame assembly in accordance with the invention having a poster mounted thereon which is partly cut away to expose the backing plate of the assembly.

Referring now to the drawing and in particular to FIG. 1, there is shown a unitary frame assembly according to the invention, generally designated by numeral 10, which is molded of flexible synthetic plastic material such as polyvinyl chloride, polyethylene or polypropylene. The assembly is shown with a poster 11 mounted therein, the poster being partly cut away to reveal the underlying structure.

The frame assembly 10 includes a rectangular backing plate 12 whose dimensions are slightly smaller than those of the poster, so that narrow margins of the poster extend beyond the backing plate. Backing plate 12 is bordered by a rectangular frame formed by a top branch 13, a bottom branch 14, and left and right side branches 15 and 16 which are integrated with each other, the branches being hollow and having a rectangular channel-shaped cross section. Top branch 13 is spaced from the upper edge of backing plate 12 to form an inlet gap 17.

Figure 2:
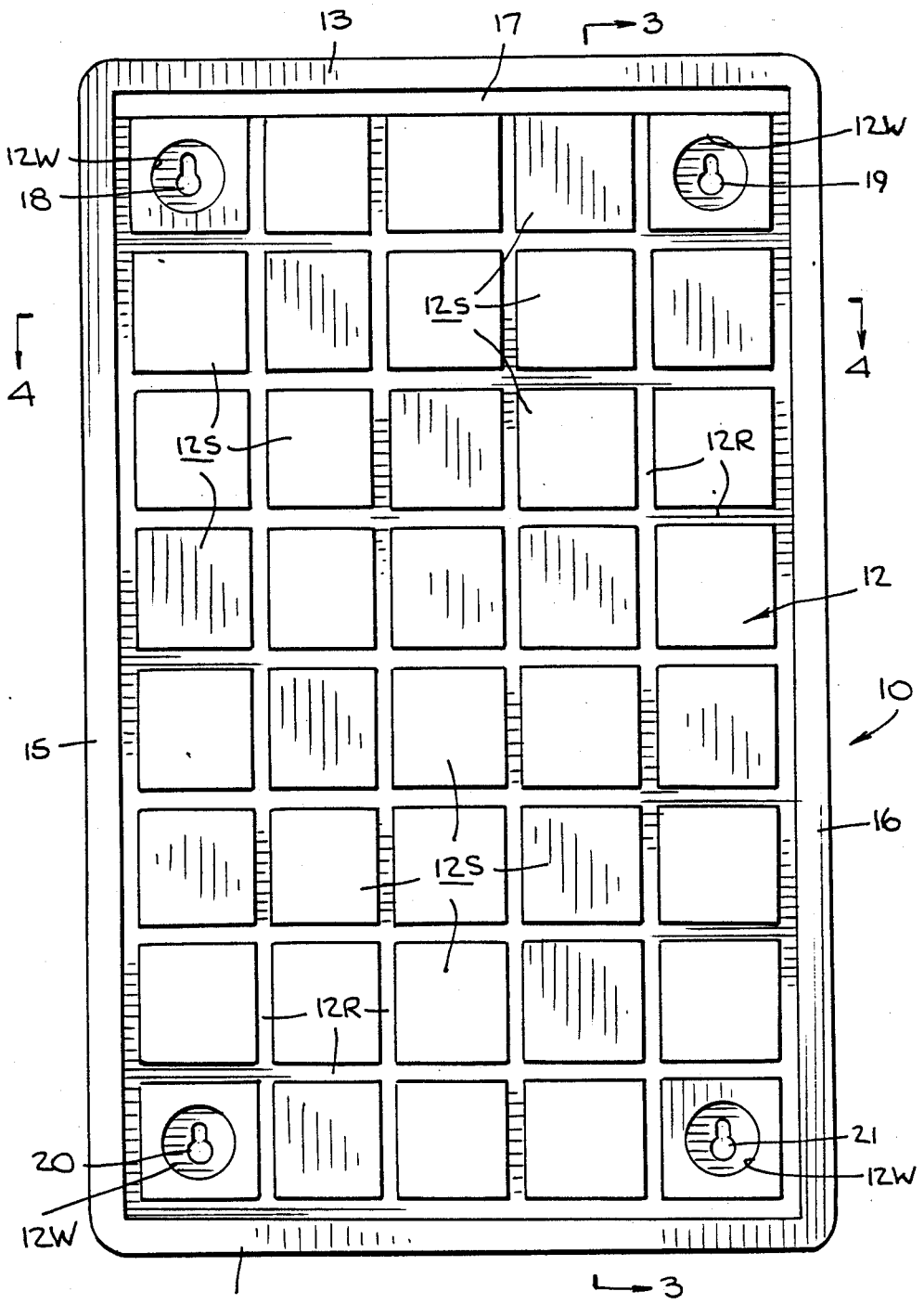
FIG. 2 is a front view of the assembly without a poster mounted thereon.
Figure 3:
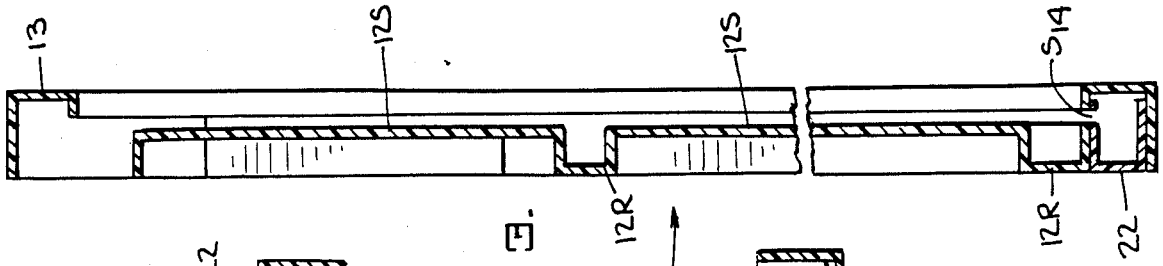
Fig. 3 is a longitudinal section taken in the plane indicated by line 3—3 in FIG. 2.
Figure 4:
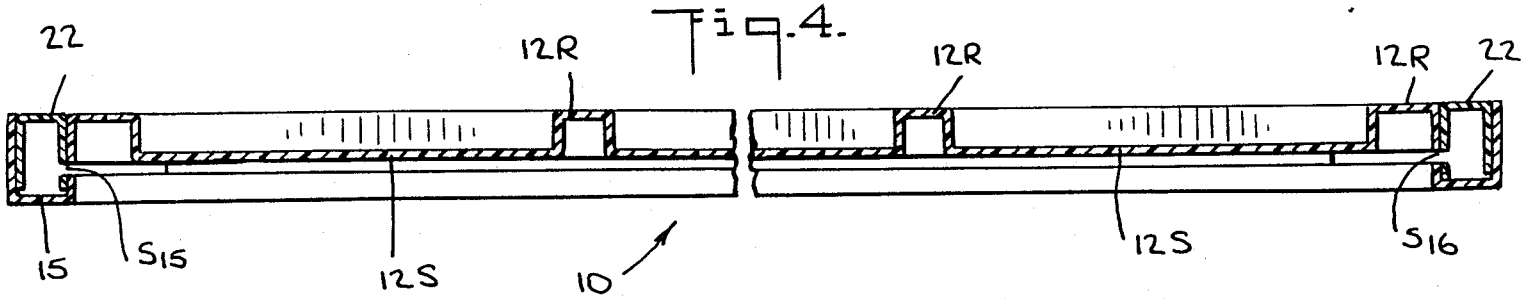
FIG. 4 is a transverse section taken in the plane indicated by lines 4—4 in FIG. 2.

As best seen in FIGS. 2, 3 and 4, molded backing plate 12 is so indented as to create an array of flat squares 12S which are raised with respect to an X-Y grid of channels which form reinforcing ribs 12R which act to rigidify the backing plate. Indented into the corner squares 12S of the arrays are circular wells 12W having keyholes 18, 19, 20 and 21 cut therein. These keyholes facilitate suspending the assembly on a wall by means of screws or other studs inserted in the wall at positions that register with the keyholes so that one has merely to place the frame assembly against the heads of the wall screws to permit the screw heads to enter the keyholes.

Received within the channels of side branches 15 and 16 and the bottom branch 14 of the frame are elongated channel pieces 22 which are in reverse relationship to the branch channels and thereby close these channels. The channel pieces 22 are bonded to the frame branches 14, 15 and 16 in order to maintain the connection of these branches to the backing plate 12 when longitudinally-extending slots are cut into the inner wall of the frame branches, which slots also go through the channel pieces. Thus, FIG. 4 shows a slot $S_{15}$ in side branch 15.

As shown in FIG. 1 in dotted lines, the inner walls of the side branches 15 and 16 and the bottom branch 14 of the frame are slotted to create slots $S_{15}$, $S_{16}$ and $S_{14}$ which together define a U-shaped socket for receiving the corresponding margins of poster 10.

Figure 5:
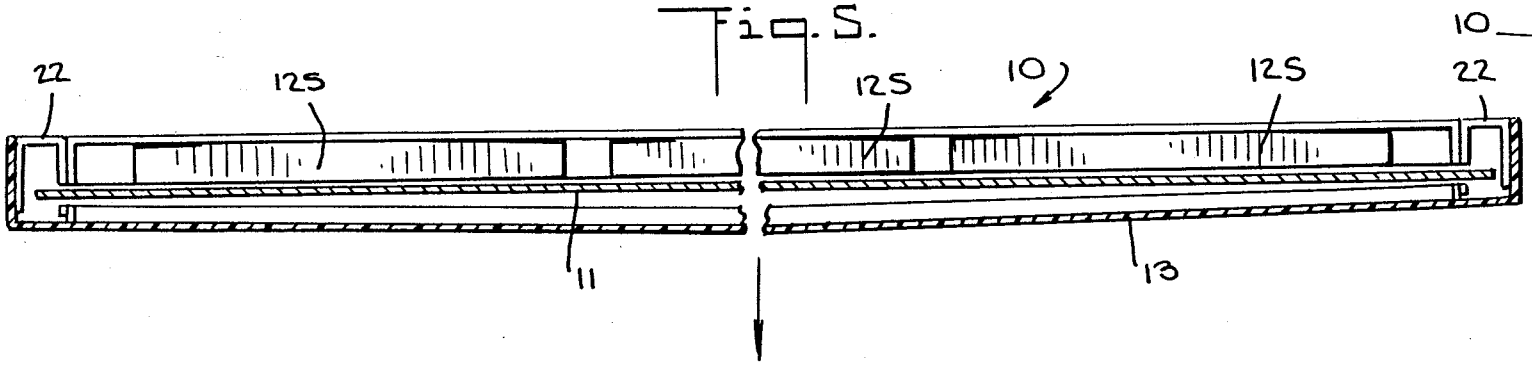
FIG. 5 shows the top branch of the assembly being flexed down to admit the poster into the assembly.

In order to insert poster 10 into the frame assembly, as shown in FIG. 5 the top branch 14 is temporarily bent down so as to make inlet gap 17 accessible to the lower end of the poster which is then inserted so that its side margins are received in slots $15_S$ and $16_S$ in the side branches of the frame. The poster is then pushed into these slots until its lower margin falls into the slot in the lower branch 14 of the frame, at which point the poster is fully mounted and the top branch is permitted to resume its normal unflexed state.

In order to replace the poster with another poster, one reverses the procedure, the top branch being then flexed to permit withdrawal of the poster from the slotted socket in the frame.

In the form shown, the rectangular frame of the assembly is of simple, unadorned design and in a color such as black or red, determined by the pigment of the plastic molding component. But because the assembly is formed of thermoplastic material, a decorative geometric, floral or other design may be impressed thereon so as to lend greater interest to the frame.

While there has been shown and described a preferred embodiment of a unitary poster frame assembly in accordance with the invention, it will be appreciated that many changes and modifications may be made therein without, however, departing from the essential spirit thereof. Thus, while the invention has been described as a means for framing posters, in practice it may be made in smaller sizes to frame photographs formed on relatively stiff paper or cardboard.

I claim:

1. A unitary frame assembly for mounting a poster or the like comprising:

(A) a rectangular backing plate molded of synthetic, plastic, flexible material whose dimensions are slightly smaller than those of the poster; and (B) a one-piece frame molded of synthetic, plastic, flexible material bordering the plate and integral therewith, said frame having top, bottom and left and right side branches having a channel-shaped rectangular cross section, and channel-shaped pieces inserted in inverted relation in the channels of the side branches and the bottom branch and bonded thereto, the top branch being spaced from the upper edge of the plate to form an inlet gap, the inner walls of the frame branches, save for the top branch, having slots therein to define a U-shaped socket for receiving the corresponding margins of the poster supported on the backing plate, whereby to install a given poster, the top branch is temporarily bent back to admit the lower end of the poster into the inlet gap to permit insertion of the side margins thereof into the slots of the side branches, the poster then being pushed down until its bottom margin lies in the slot of the bottom branch, at which point the given poster is fully socketed; and to replace the given poster the top branch is again bent back to permit withdrawal of the given poster form the socket and to permit insertion of the new poster therein.

2. An assembly as set forth in claim 1, wherein said plate is indented to define an array of flat squares which are raised relative to a grid of channels forming reinforcing ribs to rigidify the plate.

3. An assembly as set forth in claim 2, wherein the squares at the corners of the plates are provided with indented circular wells having keyholes therein to facilitate mounting of the assembly on a wall.

* * * * *